US006500074B1

(12) United States Patent
Thacker

(10) Patent No.: US 6,500,074 B1
(45) Date of Patent: Dec. 31, 2002

(54) GOLF CLUB

(76) Inventor: Geoffrey Wayne Thacker, 6753 Oaks Rd., Brecksville, OH (US) 44141

( * ) Notice: Subject to any disclaimer, the term of this patent is extended or adjusted under 35 U.S.C. 154(b) by 39 days.

(21) Appl. No.: 09/891,046

(22) Filed: Jun. 25, 2001

Related U.S. Application Data

(60) Provisional application No. 60/214,022, filed on Jun. 26, 2000.

(51) Int. Cl.[7] ..... A63B 69/36

(52) U.S. Cl. ..... 473/234; 473/409

(58) Field of Search ..... 473/224, 234, 473/297, 252, 256, 219, 233, 457, 519, 461, 453, 409

(56) References Cited

U.S. PATENT DOCUMENTS

| | | | | |
|---|---|---|---|---|
| 1,676,270 | A | | 7/1928 | Mattison |
| 3,075,768 | A | * | 1/1963 | Karns |
| 3,137,504 | A | * | 6/1964 | Zordan |
| 3,215,437 | A | | 11/1965 | Webb |
| 3,303,863 | A | * | 2/1967 | Titchnell |
| 3,498,616 | A | * | 3/1970 | Hurst |
| 4,027,886 | A | * | 6/1977 | Katsube |
| 4,090,711 | A | * | 5/1978 | Amato |
| 4,598,911 | A | | 7/1986 | Lepera |
| 4,664,388 | A | | 5/1987 | Huber |
| 5,082,279 | A | * | 1/1992 | Hull |
| 5,244,209 | A | * | 9/1993 | Benzel |
| 5,470,071 | A | | 11/1995 | Hsu et al. |
| 5,524,892 | A | * | 6/1996 | Karp |
| 5,527,038 | A | | 6/1996 | Mabie |
| 5,634,856 | A | | 6/1997 | Rainey |
| 5,911,635 | A | | 6/1999 | Ogden |
| 6,012,988 | A | * | 1/2000 | Burke |
| 6,196,933 | B1 | | 3/2001 | Hope et al. |

* cited by examiner

*Primary Examiner*—Sebastiano Passaniti
(74) *Attorney, Agent, or Firm*—Renner, Otto, Boisselle & Sklar, L.L.P.

(57) ABSTRACT

A golf club (10) comprises a shaft (12), a grip area (14) at an upper portion of the shaft (12), and a head (16) attached to the bottom end of the shaft (12). The shaft (12) has a chamber (18) with a percussion surface (20) positioned at an upper end thereof and a stop (22) defining a lower end thereof. Percussion impact objects (24,26) are movably contained within the chamber (18). At the end of backswing, the percussion impact objects (24,26) strike the percussion surface (20) to provide an audio signal to a golfer that he/she has paused sufficiently and can begin the downswing.

16 Claims, 1 Drawing Sheet

GOLF CLUB

RELATED APPLICATIONS

This application claims priority under 35 U.S.C. §119(e) to U.S. Provisional Patent Application No. 60/214,022 filed on Jun. 26, 2000. The entire disclosure of this earlier application is hereby incorporated by reference.

FIELD OF THE INVENTION

This invention relates generally as indicated to a golf club and, more particularly, to a golf club which provides an indication to a golfer to begin his/her downswing.

BACKGROUND OF THE INVENTION

A proper swing is essential to mastery of the game of golf. Without a proper swing, it is impossible to drive the golf ball with consistent accuracy and the desired force, both of which are essential to the realization of a satisfying golf game. Of particular relevance to the present invention is the pause at the top of the backswing which is crucial to insure a controlled downswing. While many golf swing instructional devices have been developed to help a golfer improve his/her swing, these devices do not address the appropriate pause that is required to perfect a swing, they require expensive and complicated equipment, and/or they can only be used in practice settings.

SUMMARY OF THE INVENTION

The present invention provides a golf club which incorporates an indicating device for signaling a golfer that he/she should begin the downswing. The signal can be audio and the indicating device can comprise ball bearings and a washer positioned within the shaft of the golf club whereby it does not require expensive or complicated equipment. Furthermore, the golf club according to the present invention can be used in practice settings and also during actual games to improve a golfer's swing.

More particularly, the present invention provides a golf club comprising a shaft having a chamber with a percussion surface positioned at an upper end thereof and at least one percussion impact object movably positioned within the chamber which strikes the percussion surface to provide a signal to a golfer that an appropriate pause has been taken at a top of his/her backswing. The percussion impact object(s) can comprise a ball member (e.g., a ball bearing) and the percussion surface can comprise a washer fixedly mounted at the upper end of the chamber. A further ball member (e.g., a ball bearing) having a diameter greater than the diameter of the chamber can be used as a stop defining a lower end of the chamber. Preferably, the chamber occupies an upper portion of the shaft within the grip area (e.g., the upper 25% of the shaft).

These and other features of the invention are fully described and particularly pointed out in the claims. The following descriptive annexed drawings set forth in detail certain illustrative embodiments of the invention, these embodiments being indicative of but a few of the various ways in which the principles of the invention may be employed.

DRAWINGS

DETAILED DESCRIPTION

Figure 1:
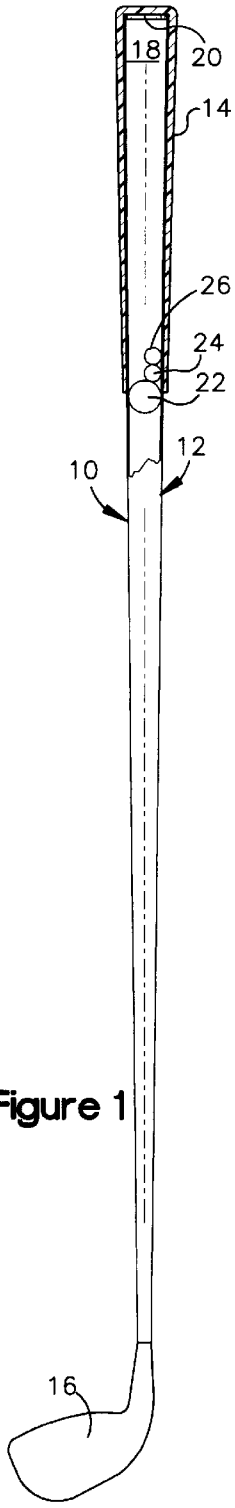
FIG. 1 is a sectional view of a golf club according to the present invention, the golf club incorporating an indicating device which provides a signal to a golfer that an appropriate pause has been taken at a top of his/her backswing.
Figure 2A:
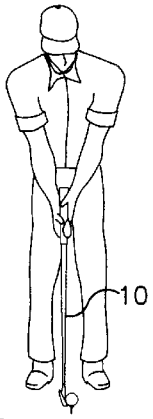
FIGS. 2A–2D are schematic views of a method of practicing a golf swing according to the present invention.
Figure 2B:
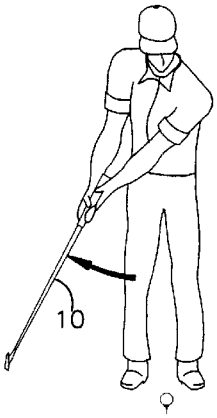
Figure 2C:
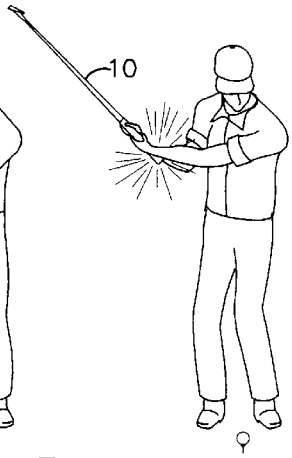
Figure 2D:
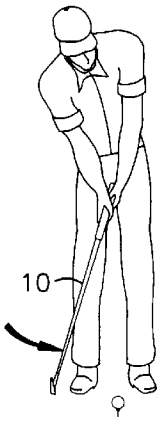

Referring now to the drawing in detail, and initially to FIG. 1, a golf club 10 according to the present invention is shown. The golf club 10 comprises a shaft 12, a grip area 14 at an upper portion of the shaft 12, and a head 16 attached to the bottom end of the shaft 12. At least an upper portion (e.g., about 25% of shaft length) is hollow and forms a chamber 18 in the grip area 14. A washer 20 is fixedly mounted to an upper end of the chamber 18, a ball bearing 22 is fixedly mounted to a lower end of the chamber 18, and ball bearings 24 and 26 are movably contained within the chamber 18 so that they can roll freely therein. The washer 20 and ball bearings 22, 24 and 26 form an indicating device for signaling a golfer that an appropriate pause has been taken at the top of his/her backswing.

Figure 3A:
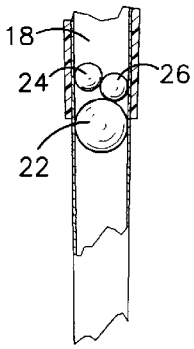
FIGS. 3A–3C are schematic views of the indicating device during the method steps shown in FIGS. 2A–2C, respectively.
Figure 3B:
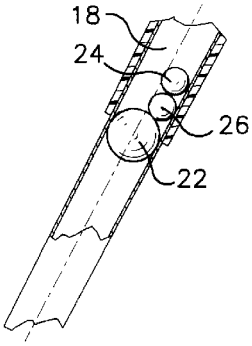
Figure 3C:
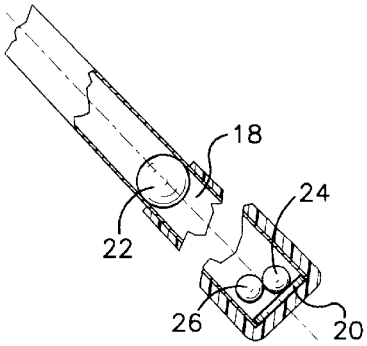

Referring now to FIGS. 2 and 3, a method of using the golf club 10 according to the present invention is shown. Initially, a golfer is positioned for a pitching wedge, and the ball bearings 24 and 26 will be positioned adjacent the ball bearing 22 in the chamber 18. (FIGS. 2A and 3A.) During the golfer's backswing, the ball bearings 24 and 26 roll towards the washer 20. (FIGS. 2B and 3B.) The golfer waits until he/she hears the ball bearings 24 and 26 striking the washer 20. (FIGS. 2C and 3C.) Upon receiving this signal, the golfer then knows that an appropriate pause has been taken at the top of his/her golf swing and then proceeds to start the down swing. (FIG. 2D.) Repeated use of the golf club 10 develops muscle memory and enhances the ability of the golfer to relax at the top of the swing and gain control of the down swing. The control gained with use of the golf club 10 enables a golfer to incorporate this technique with all clubs, even a putter.

In the illustrated indicating device, the washer 20 is a percussion surface, the ball bearings 24 and 26 are percussion impact objects which impact the percussion surface to create an audio signal, and the ball bearing 26 forms a stop or plug to contain the impact objects within the chamber 18. Accordingly, these components can easily be replaced by other appropriate percussion surfaces, percussion impact objects, and plugs. Also, non-percussion components can be used to convey an appropriate audio signal. Furthermore, visual, sensory, and other types of indicating device which signal that the correct pause has been taken at the top of a backswing are possible with, and contemplated by, the present invention. However, it should be noted that a visual signal would require a golfer to glance over his/her shoulder to receive the appropriate-pause signal whereby this might not be desirable in certain situations.

One can now appreciate that the present invention provides a golf club having an indicating device which addresses the appropriate pause that is required to perfect a swing, which need not require expensive and complicated equipment, and/or which can be used both in practice and game settings. One can further appreciate that although the invention has been shown and described with respect to a certain preferred embodiment, obvious and/or equivalent alterations and modifications will occur to others skilled in the art upon the reading and understanding of this specification. The present invention includes all equivalent alterations and modifications and is limited only by the scope of the following claims.

What is claimed is:

1. A golf club comprising:

an elongated shaft having a chamber disposed therein between opposite ends of the shaft and having a percussion surface positioned at an upper end of the chamber;

a grip area at an upper portion of the shaft;

a head attached to a bottom end of the shaft; and at least one percussion impact object movably positioned within the chamber which strikes the percussion surface, this strike producing a percussion signal to a golfer that an appropriate pause has been taken at a top of his or her backswing.

2. A golf club as set forth in claim 1, wherein the percussion impact object comprises a ball member.

3. A golf club as set forth in claim 2, wherein the ball member comprises a ball bearing.

4. A golf club as set forth in claim 1, comprising a plurality of percussion impact objects.

5. A golf club as set forth in claim 4, wherein the plurality of percussion impact objects comprises two ball members.

6. A golf club as set forth in claim 5, wherein the ball members comprise ball bearings.

7. A golf club as set forth in claim 1, further comprising a stop defining a lower end of the chamber.

8. A golf club as set forth in claim 7, wherein the stop comprises a ball member having a diameter greater than the diameter of the chamber.

9. A golf club as set forth in claim 1, wherein the chamber occupies an upper portion of the shaft within the grip area.

10. A golf club as set forth in claim 9, wherein the chamber occupies an upper 25% of the shaft.

11. A golf club as set forth in claim 1, wherein:

the chamber occupies an upper 25% of the shaft within the grip area;

the percussion surface comprises a washer positioned at an upper end of the chamber;

a lower end of the chamber is defined by a ball member having a diameter greater than the diameter of the chamber; and the percussion object comprises a ball bearing having a diameter less than the diameter of the chamber.

12. A golf club comprising:

a shaft having a chamber with a percussion surface positioned at an upper end thereof;

a grip area at an upper portion of the shaft;

a head attached to a bottom end of the shaft; and at least one percussion impact object movably positioned within the chamber which strikes the percussion surface to provide a signal to a golfer that an appropriate pause has been taken at a top of his or her backswing;

wherein the percussion impact object comprises a ball member and wherein the ball member comprises a ball bearing; and wherein the percussion surface comprises a washer fixedly mounted at the upper end of the chamber.

13. A golf club as set forth in claim 12, further comprising a stop defining a lower end of the chamber.

14. A golf club as set forth in claim 13, wherein the stop comprises a ball member having a diameter greater than the diameter of the chamber.

15. A golf club comprising:

a shaft having a chamber with a percussion surface positioned at an upper end thereof;

a grip area at an upper portion of the shaft;

a head attached to a bottom end of the shaft; and at least one percussion impact object movably positioned within the chamber which strikes the percussion surface to provide a signal to a golfer that an appropriate pause has been taken at a top of his or her backswing;

wherein the percussion surface comprises a washer fixedly mounted at the upper end of the chamber.

16. A method of practicing a golf swing comprising the steps of:

positioning the golf club of claim 1 for a pitching wedge;

backswinging the golf club; and downswinging the golf club after hearing the percussion impact object strike the percussion surface.

* * * * *